US011566466B2

(12) United States Patent
Dahl et al.

(10) Patent No.: US 11,566,466 B2
(45) Date of Patent: Jan. 31, 2023

(54) ACOUSTIC SHUTTER ASSEMBLY

(71) Applicant: Ramboll Denmark Contracting ApS, Copenhagen (DK)

(72) Inventors: Svend Erik Paulsen Dahl, Hedehusene (DK); Jakob Blauenfeldt-Dydensborg, Dragor (DK); Jørn Krab Jensen, Copenhagen (DK); Frederik Wolter Holm, Copenhagen (DK)

(73) Assignee: Ramboll Denmark Contracting APS, Copenhagen (DK)

( * ) Notice: Subject to any disclaimer, the term of this patent is extended or adjusted under 35 U.S.C. 154(b) by 104 days.

(21) Appl. No.: 16/757,164

(22) PCT Filed: Oct. 11, 2018

(86) PCT No.: PCT/EP2018/077759
§ 371 (c)(1),
(2) Date: Apr. 17, 2020

(87) PCT Pub. No.: WO2019/076730
PCT Pub. Date: Apr. 25, 2019

(65) Prior Publication Data

US 2020/0240203 A1 Jul. 30, 2020

(30) Foreign Application Priority Data

Oct. 18, 2017 (DK) ..... PA201770795

(51) Int. Cl.
*E06B 5/20* (2006.01)
*E06B 9/04* (2006.01)
(Continued)

(52) U.S. Cl.
CPC ..... *E06B 5/20* (2013.01); *E06B 7/10* (2013.01); *E06B 9/04* (2013.01); *F24F 13/18* (2013.01);
(Continued)

(58) Field of Classification Search
CPC ..... E06B 5/20; E06B 7/10; E06B 9/04; E06B 5/205; E06B 7/02; F24F 13/18;
(Continued)

(56) References Cited

U.S. PATENT DOCUMENTS 979,267 A * 12/1910 Dix ..... E04F 10/02 160/49
1,783,276 A * 12/1930 Bliss ..... E06B 7/10 55/444
(Continued)

FOREIGN PATENT DOCUMENTS

CN 2816299 Y 9/2006
CN 101215950 A 7/2008
(Continued)

OTHER PUBLICATIONS

International Search Report and the Written Opinion dated Dec. 13, 2018, for corresponding International Patent Application PCT/EP2018/077759 filed Oct. 11, 2018.

*Primary Examiner* — Justin B Rephann
(74) *Attorney, Agent, or Firm* — Winthrop & Weinstine, P.A.

(57) ABSTRACT

The acoustic shutter assembly (1) includes at least one window pane (2, 3) arranged in a frame (4). At least one ventilation duct (7) is arranged in the frame between an outer ventilation opening (8) and an inner ventilation opening (9), extending between a first layer of sound absorbing material arranged at an inside (5) and a second layer of sound absorbing material arranged at an outside. A number of acoustic reflectors (12) in the form of plate material are arranged between the first and second layers of sound absorbing material so that the ventilation duct is separated into a number of respective ventilation channels (13) formed between the acoustic reflectors. Each ventilation channel changes direction at least once between the outer ventilation
(Continued)

opening and the inner ventilation opening, thereby at least substantially blocking any linear path from the outer ventilation opening to the inner ventilation opening.

20 Claims, 5 Drawing Sheets

(51) Int. Cl.
*F24F 13/24* (2006.01)
*E06B 7/10* (2006.01)
*F24F 13/18* (2006.01)
*G10K 11/168* (2006.01)

(52) U.S. Cl.
CPC ..... *F24F 13/24* (2013.01); *G10K 11/168* (2013.01); *Y10S 454/906* (2013.01)

(58) Field of Classification Search
CPC .. F24F 13/24; F24F 2013/242; G10K 11/168; Y10S 454/906
See application file for complete search history.

(56) References Cited

U.S. PATENT DOCUMENTS 1,865,677 A * 7/1932 Cheyney ..... F24F 13/24 181/256
1,929,595 A * 10/1933 MacLeod ..... E06B 7/084 49/54
1,990,520 A * 2/1935 Binger ..... F24F 13/24 49/70
2,676,678 A * 4/1954 Jacobson ..... E04C 2/08 181/290
2,704,504 A * 3/1955 Wilkening ..... F24F 13/24 454/906
3,378,100 A * 4/1968 Welty ..... F24F 13/24 181/224
3,452,477 A * 7/1969 Sassano ..... E06B 9/04 49/362
4,363,351 A * 12/1982 Eriksen ..... E06B 9/0638 160/187
4,454,691 A * 6/1984 Mitchell ..... E06B 9/0669 160/117
5,723,831 A * 3/1998 Martin ..... E04B 2/7411 181/290
6,648,750 B1 * 11/2003 Wiseman ..... F24F 13/18 454/211
8,511,426 B2 * 8/2013 Colam ..... F16L 55/0336 181/224
10,244,662 B2 * 3/2019 LaPree ..... F24F 13/24
10,842,051 B2 * 11/2020 Lapree ..... H05K 7/20181
2002/0115406 A1 * 8/2002 Ruach ..... F24F 13/02 454/906
2006/0118356 A1 * 6/2006 Beeson ..... E06B 7/08 181/290
2008/0230305 A1 * 9/2008 Goto ..... G06F 1/182 181/224
2015/0176327 A1 * 6/2015 Goyco-Graziani ..... E06B 5/205 49/89.1
2015/0267404 A1 * 9/2015 Yau ..... F24F 13/0227 52/794.1
2018/0298675 A1 * 10/2018 Bibens ..... G10K 11/17861

FOREIGN PATENT DOCUMENTS

CN 106677685 A 5/2017
DE 19751959 A1 6/1999
GB 1 547 786 A 6/1979
WO 2012/164349 A1 12/2012

* cited by examiner

ACOUSTIC SHUTTER ASSEMBLY

The present invention relates to an acoustic shutter assembly adapted to cover a window opening in a wall, including at least one window pane arranged in a frame having an inside adapted to be mounted on the wall and an outside adapted to face away from the wall, wherein at least one ventilation duct is arranged in the frame between an outer ventilation opening and an inner ventilation opening, wherein the ventilation duct extends between a first layer of sound absorbing material arranged at the inside of the frame and a second layer of sound absorbing material arranged at the outside of the frame, and wherein the first and second layers of sound absorbing material extend at least substantially in parallel with the window pane.

DE 296 08 765 U1 discloses a noise reducing window attachment to be mounted on the outside of an existing window. In the window attachment, labyrinths are arranged at either side and at the top in order to reduce the entrance of traffic noise, but to allow air exchange. Sound insulation is provided at the bottom. However, although this window attachment may reduce the entrance of traffic noise somewhat, in areas of heavy traffic, especially low frequency noise may still be a problem.

CN104675287 A discloses a daylighting, ventilation and noise reduction window to be mounted on window openings. A ventilation noise reducer in the form of a simple labyrinth is arranged on the periphery of the glass window.

Furthermore, an acoustic shutter assembly is known which is adapted to cover a window opening in a wall, and in which the ventilation air enters at either side through respective ducts formed between an outer and an inner layer of sound absorbing material.

The object of the present invention is to provide an acoustic shutter assembly having improved soundproofing properties compared to known solutions, without compromising ventilation properties.

In view of this object, a number of acoustic reflectors in the form of plate material are arranged between the first and second layers of sound absorbing material so that the ventilation duct is separated into a number of respective ventilation channels formed between the acoustic reflectors, and each ventilation channel changes direction at least once between the outer ventilation opening and the inner ventilation opening, thereby at least substantially blocking any linear path from the outer ventilation opening to the inner ventilation opening.

The combination of the acoustic reflectors blocking any linear path from the outer ventilation opening to the inner ventilation opening and the first and second layer of sound absorbing material forming the ventilation duct may significantly reduce the noise entering through the acoustic shutter assembly without reducing the ventilation capabilities of the assembly.

In an embodiment, the ventilation duct is lined by means of a first perforated plate covering the first layer of sound absorbing material and a second perforated plate covering the second layer of sound absorbing material so that the acoustic reflectors extend from the first perforated plate to the second perforated plate. Thereby, sound waves may pass through the perforations in the plate and subsequently be absorbed by the layer of sound absorbing material. The perforated plate may serve to hold the sound absorbing material in place and provide a smooth surface of the inside of the ventilation duct, thereby ensuring free movement of ventilation air. The perforated plate may preferably be a metal plate and the acoustic reflectors may preferably be fixed to the perforated plates, preferably by welding or soldering, thereby providing increased stability and consequently better sound absorption.

In an embodiment, the first layer of sound absorbing material has a first thickness and the second layer of sound absorbing material has a second thickness, and the second thickness is greater than the first thickness. Thereby, the relatively greater thickness of the second layer of sound absorbing material may ensure that low frequency noise is absorbed, and the relatively smaller thickness of the first layer of sound absorbing material may ensure that the total thickness of the first and second layers of sound absorbing material is relatively thin. By arranging the thickest layer of sound absorbing material, the second layer, at the outside of the frame, this thickest layer of sound absorbing material may furthermore provide additional sound insulation against noise entering the ventilation duct directly from the outside. Preferably, the second thickness is at least 4/3 of, more preferred at least 3/2 of, and most preferred about the double of, the first thickness.

In a structurally particularly advantageous embodiment, the plate material of each acoustic reflector is V-formed with a first leg extending obliquely towards the outer ventilation opening and a second leg extending obliquely towards the inner ventilation opening, and the first and second leg of each acoustic reflector preferably connect at least approximately midway between the outer ventilation opening and the inner ventilation opening in a top point of the acoustic reflector. Thereby, an effective noise barrier may be created in a simple way, and the V-form of the reflectors with the top point midway may prevent moisture or dust from piling up in the ventilation duct.

In a structurally particularly advantageous embodiment, each outer ventilation opening is covered by a filter in the form of a perforated plate. Thereby, insects and small particles may be prevented from entering through the acoustic shutter assembly. The perforated plate, preferably in the form of a metal plate, may also provide further stability to the entire assembly.

In a structurally particularly advantageous embodiment, the at least one ventilation duct is formed in an absorption module including a first absorption cassette holding the first layer of sound absorbing material and a second absorption cassette holding the second layer of sound absorbing material. Preferably, each absorption cassette has at least two opposed U-formed profiles holding opposed edges of the corresponding layer of sound absorbing material. Thereby, the layers of sound absorbing material may easily be mounted.

In a structurally particularly advantageous embodiment, the frame has four frame members in the form of a top member, a bottom member, a first side member and a second side member, a first ventilation duct is arranged at the first side member and a second ventilation duct is arranged at the second side member. Thereby, ventilation air may easily enter the assembly without rain and dust entering through the ventilation ducts.

In an embodiment, a first shutter is arranged in its open position at the first side member and a second shutter is arranged in its open position at the second side member, and the first and second shutters are arranged displaceably to respective closed positions thereby covering the at least one window pane. Thereby, enhanced sound insulation may be provided by the first and second shutters, for instance during night time. By this arrangement, the shutters may advantageously hide the first and second ventilation ducts in the open position of the shutters. The shutters may preferably be electrically operated from inside the building.

In a structurally particularly advantageous embodiment, the at least one window pane is separated in a first pane part arranged in its open position at the first side member and a second pane part arranged in its open position at the second side member, and the first and second pane parts are arranged displaceably to respective closed positions in which the first and second pane parts meet each other and covers the window opening.

In a structurally particularly advantageous embodiment, the pane parts are arranged displaceably in a plane extending between a plane of the first and second layers of sound absorbing material and a plane in which the first and second shutters are arranged displaceably.

The invention will now be explained in more detail below by means of examples of embodiments with reference to the very schematic drawing, in which FIG. 1 is a perspective view of an acoustic shutter assembly according to the invention, seen from the outside of the assembly, and with the right shutter and the outside of the right absorption module removed for illustration purposes;

Figure 1:
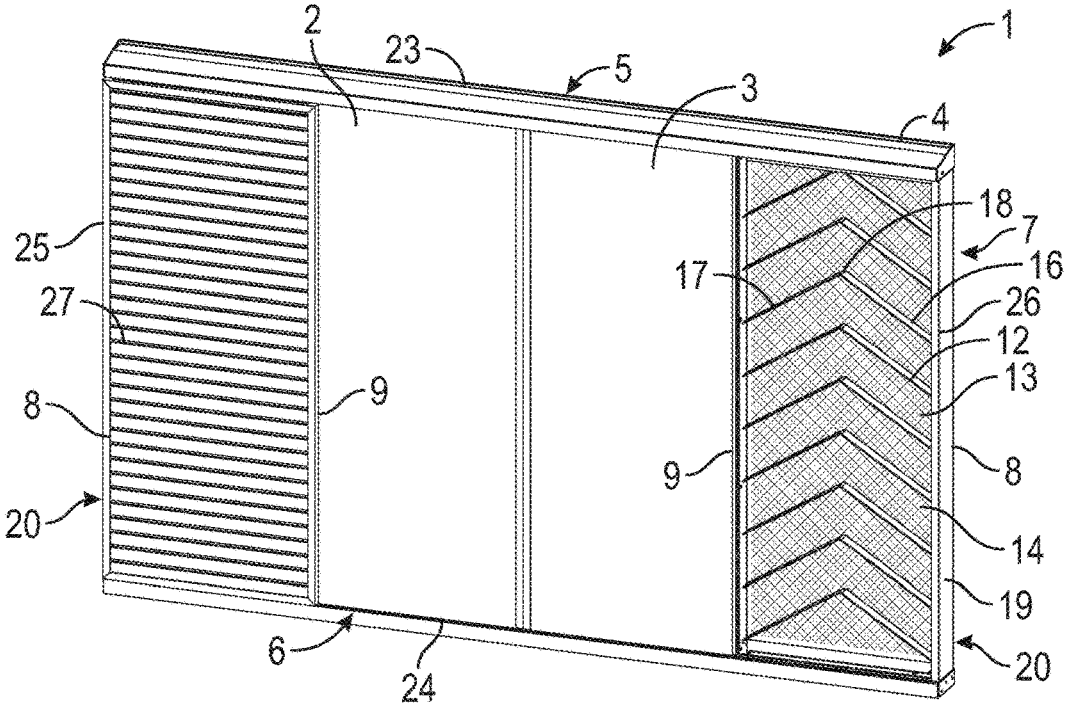
Figure 2:
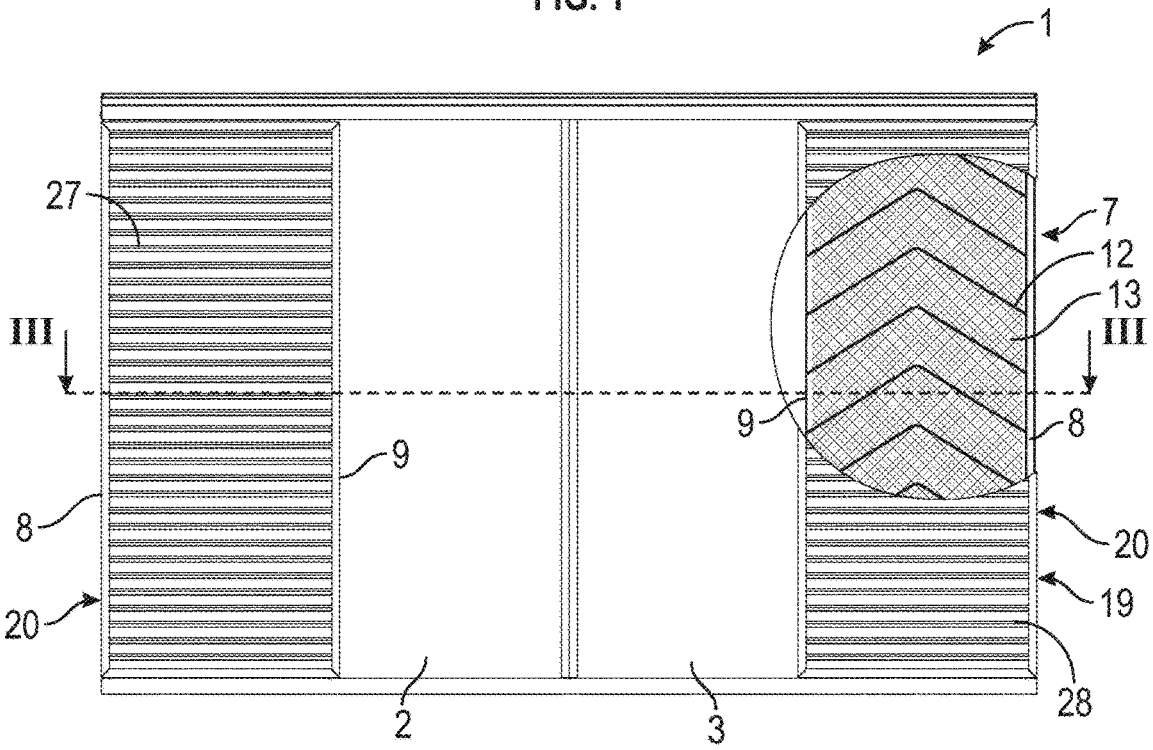
FIG. 2 is front view of the acoustic shutter assembly of FIG. 1, seen from the outside of the assembly, and with part of the right shutter and part of the outside of the right absorption module removed for illustration purposes.

FIG. 1 shows an embodiment of an acoustic shutter assembly 1 according to the present invention adapted to cover a window opening in a not shown wall. The acoustic shutter assembly 1 includes a window pane 2, 3 arranged in a frame 4 having an inside 5 adapted to be mounted on the not shown wall and an outside 6 adapted to face away from said wall. The frame 4 has four frame members in the form of a top member 23, a bottom member 24, a first side member 25 and a second side member 26.

A first ventilation duct 7 is arranged at the first side member 25 and a second ventilation duct 7 is arranged at the second side member 26. Each ventilation duct 7 is arranged in the frame 4 between an outer ventilation opening 8 and an inner ventilation opening 9, and the ventilation duct 7 extends between a first layer 10 of sound absorbing material arranged at the inside 5 of the frame 4 and a second layer 11 of sound absorbing material arranged at the outside 6 of the frame. The first and second layers 10, 11 of sound absorbing material extend at least substantially in parallel with the window pane 2, 3.

Figure 10:
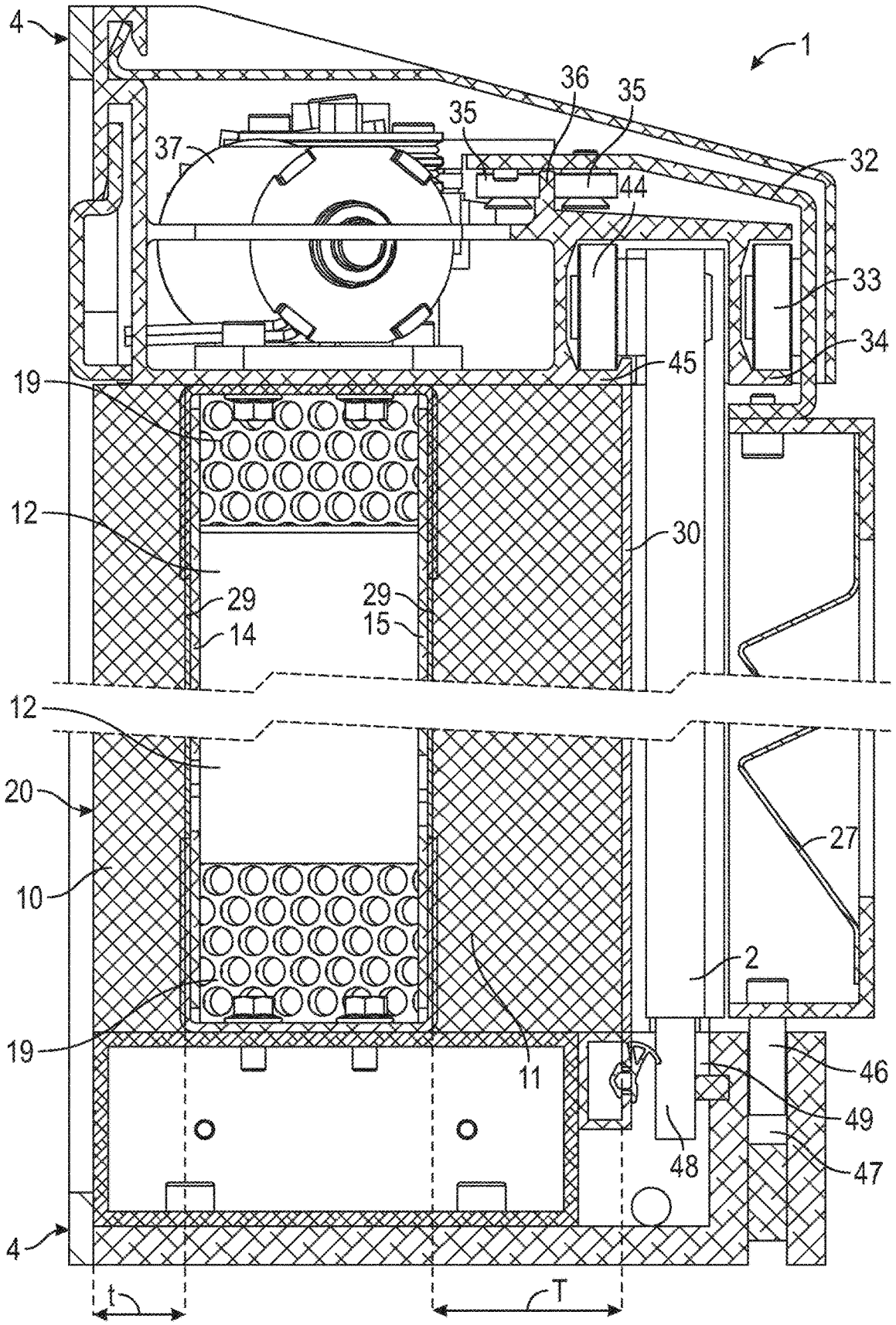
FIG. 10 illustrates in part, and on a larger scale, a cross-section along the line X-X of FIG. 9.

A number of acoustic reflectors 12 in the form of metal plate material are arranged between the first and second layers 10, 11 of sound absorbing material so that each ventilation duct 7 is separated into a number of respective ventilation channels 13 formed between the acoustic reflectors 12. The metal plate material of each acoustic reflector 12 is V-formed with a first leg 16 extending obliquely towards the outer ventilation opening 8 and a second leg 17 extending obliquely towards the inner ventilation opening 9. Thereby, each ventilation channel 13 changes direction between the outer ventilation opening 8 and the inner ventilation opening 9, so that any linear path from the outer ventilation 8 opening to the inner ventilation opening 9 is blocked. This may of course be achieved with many other forms of the acoustic reflectors 12 than the illustrated V-form. For instance, the acoustic reflectors 12 could form an arc. In the illustrated embodiment, the first and second legs 16, 17 of each acoustic reflector 12 connect midway between the outer ventilation opening 8 and the inner ventilation opening 9 in a top point 18 of the acoustic reflector 12. As illustrated in FIG. 10, each outer ventilation opening 8 is covered by a filter 19 in the form of a perforated plate.

Each ventilation duct 7 is lined by means of a first perforated plate 14 covering the first layer 10 of sound absorbing material and a second perforated plate 15 covering the second layer 11 of sound absorbing material so that the acoustic reflectors 12 extend from the first perforated plate 14 to the second perforated plate 15. The acoustic reflectors 12 are welded to the first and second perforated plates 14, 15.

The first and second layers 10, 11 of sound absorbing material may be made of a PET (Polyethylene terephthalate) felt or any other suitable sound absorbing material. As illustrated in FIG. 10, between the first perforated plate 14 and the first layer 10 of sound absorbing material and between the second perforated plate 15 and the second layer 11 of sound absorbing material, a sound absorbing foil 29 is arranged that may also act as a vapour barrier.

According to the present invention, the first layer 10 of sound absorbing material has a first thickness t and the second layer 11 of sound absorbing material has a second thickness T, and the second thickness T is greater than the first thickness t. In the illustrated embodiment, the first thickness t is 20 millimetres and the second thickness T is 40 millimetres. In any way, according to the present invention, it may be preferred that the second thickness T is preferably at least 4/3 of, more preferred at least 3/2 of, and most preferred about the double of, the first thickness t.

Figure 3:
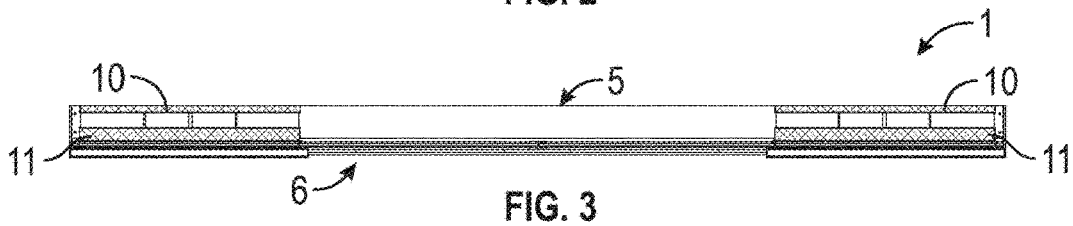
FIG. 3 is a cross-section along the line III-III of FIG. 2.
Figure 7:
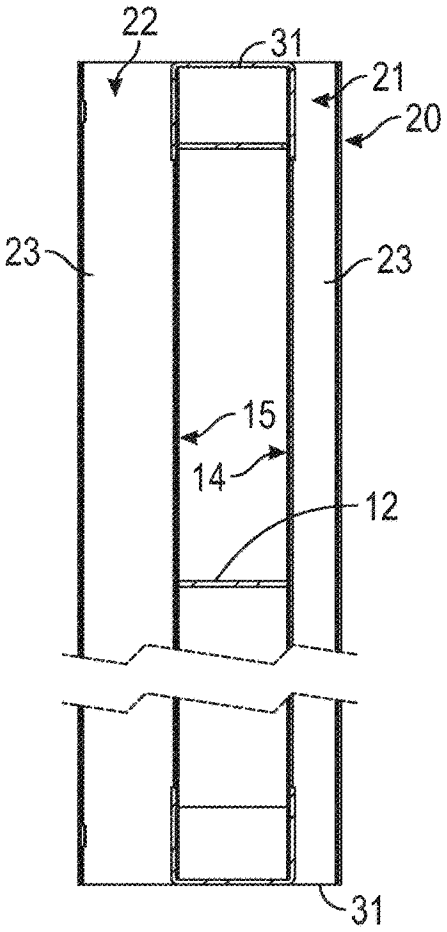
FIG. 7 is a partial cross-section along the line VII-VII of FIG. 4, seen on a larger scale and illustrating top and bottom parts of the absorption module.
Figure 6:
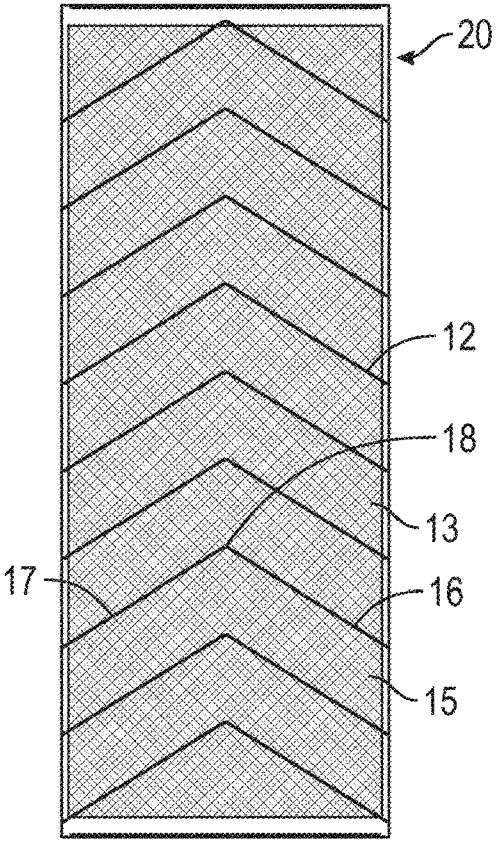
FIG. 6 is a cross-section along the line VI-VI of FIG. 5.
Figure 4:
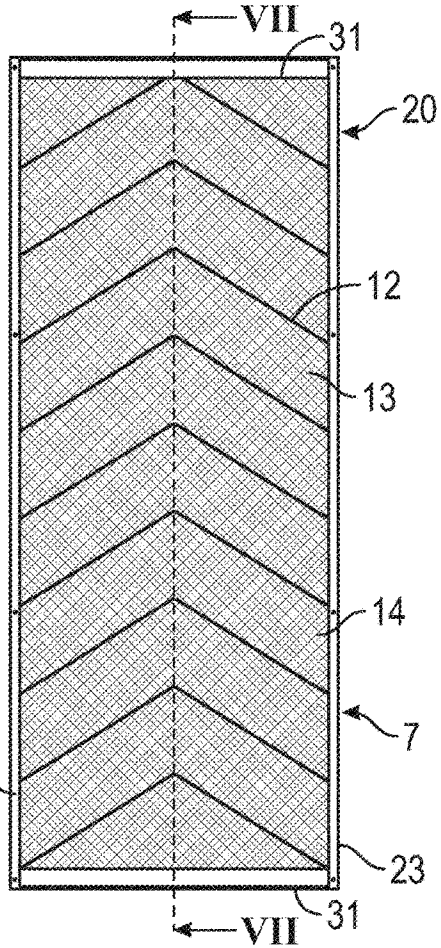
FIG. 4 is a front view of an absorption module of the acoustic shutter assembly of FIG. 1, without the first and second layers of sound absorbing material.
Figure 5:
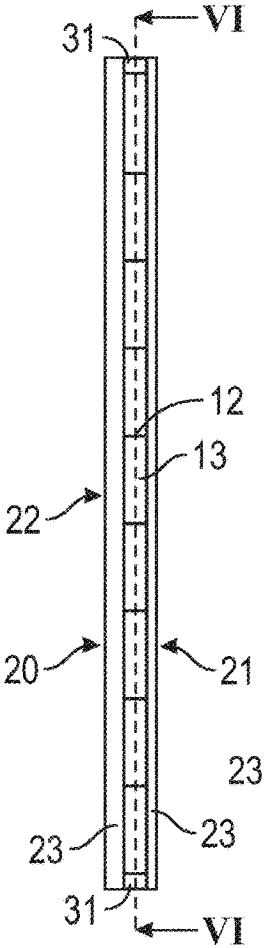
FIG. 5 is a side view of the absorption module of FIG. 4, seen from the right.
Figure 8:
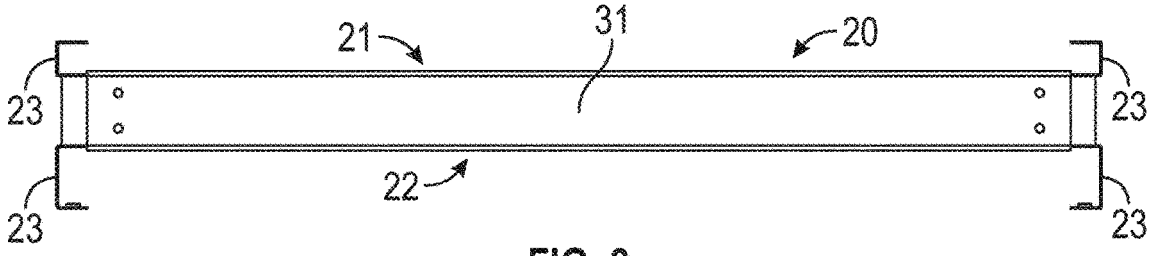
FIG. 8 is a top view of the absorption module of FIG. 4, seen on a larger scale.

As illustrated in FIGS. 4 to 8, the at least one ventilation duct 7 is formed in an absorption module 20 including a first absorption cassette 21 holding the first layer 10 of sound absorbing material and a second absorption cassette 22 holding the second layer 11 of sound absorbing material. It should be noted, however, that FIGS. 4 to 8 illustrate the absorption module 20 without the first and second layers 10, 11 of sound absorbing material. As particularly well illustrated in FIG. 8, each absorption cassette 21, 22 has two opposed U-formed profiles 23 adapted to hold opposed edges of the corresponding layer 10, 11 of sound absorbing material. The U-formed profiles 23 are welded to the vertical side edges of the first and second perforated plates 14, 15. The top and bottom edges of the first and second perforated plates 14, 15 are held together at a distance from each other in that they are welded to a U-formed profile 31. The arrangement of the layers 10, 11 of sound absorbing material in the absorption cassettes 21, 22 is illustrated in FIG. 3.

Figure 9:
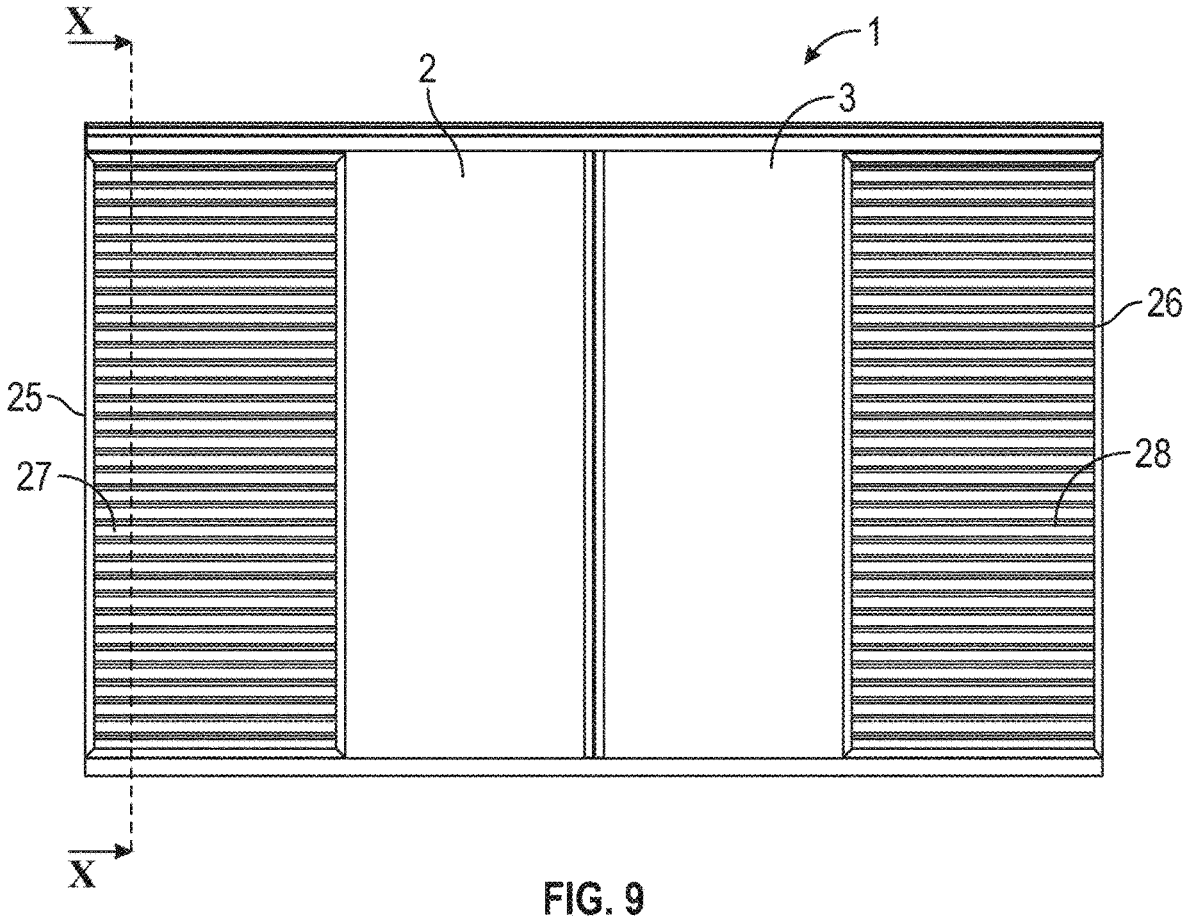
FIG. 9 is a complete front view of the acoustic shutter assembly according to the invention, corresponding to the view of FIG. 2.

As seen for instance in FIG. 9, a first shutter 27 is arranged in its open position at the first side member 25 and a second shutter 28 is arranged in its open position at the second side member 26. The first and second shutters 27, 28 are arranged displaceably to respective closed positions in which the shutters abut each other centrally and the window pane 2, 3 is covered.

As also seen in FIG. 9, the window pane 2, 3 is separated in a first pane part 2 which is slideable to its open position at the first side member 25 and a second pane part 3 which is slideable to its open position at the second side member 26. In the illustrated situation, the first and second pane parts 2, 3 are in their closed positions in which the first and second pane parts 2, 3 meet each other and covers the window opening. As seen in FIG. 10, the pane parts 2, 3 are arranged displaceably in a plane extending between the second layer 11 of sound absorbing material and a plane in which the first and second shutters 27, 28 are arranged displaceably. The front side of the second layer 11 of sound absorbing material is covered by means of a metal plate 30 in order to cover the outside of the sound absorbing material when the first and second shutters 27, 28 are moved to their closed positions.

Figures 11, 12, 13:
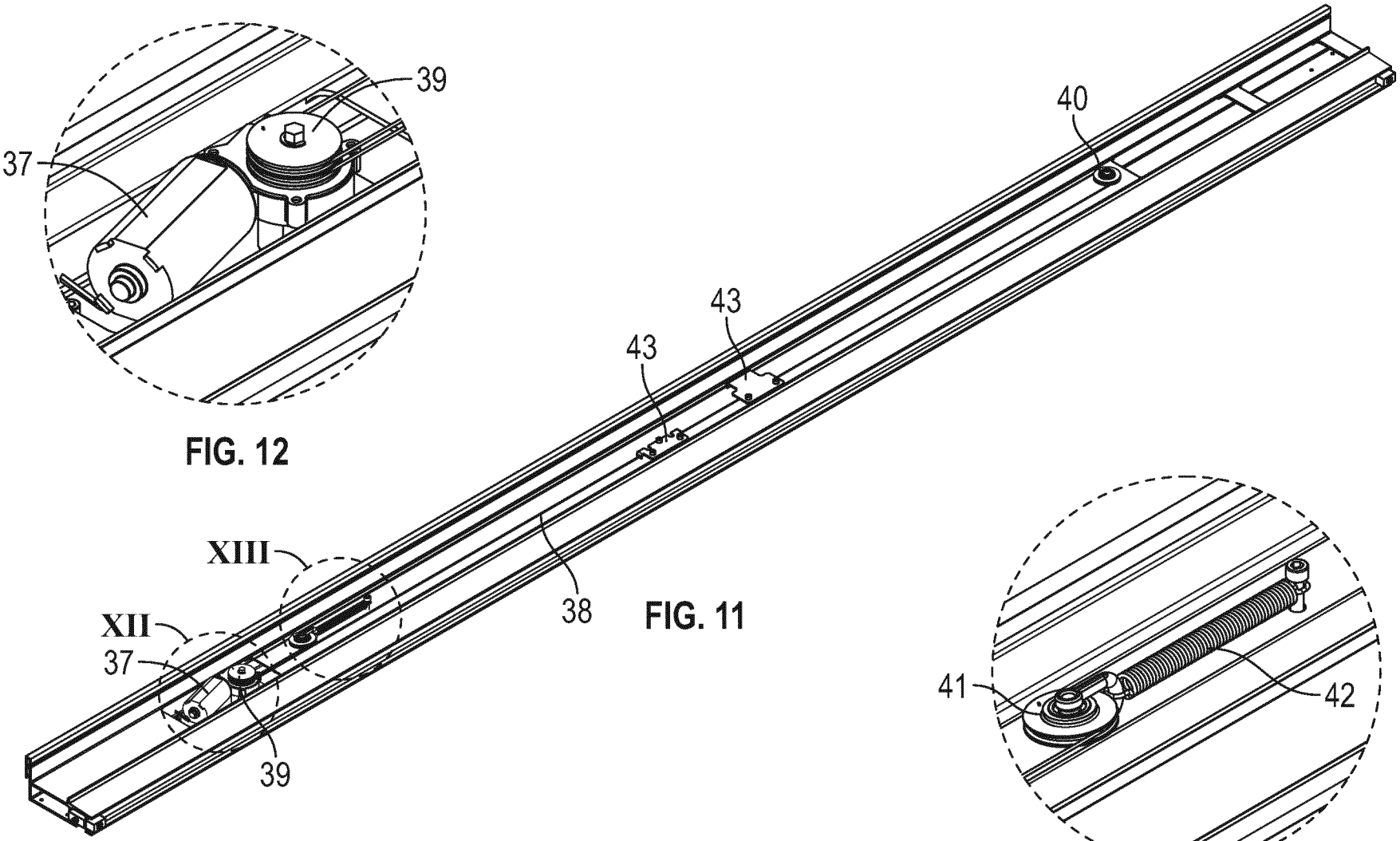
FIG. 11 is a perspective view of a top module of the acoustic shutter assembly according to the invention.
FIG. 12 is the detail XII of FIG. 11 illustrated on a larger scale.
FIG. 13 is the detail XIII of FIG. 11 illustrated on a larger scale.

As illustrated in FIGS. 10 and 11, the first and second shutters 27, 28 are arranged displaceably in that a bracket 32 mounted at the upper edge of each shutter 27, 28 carries first rollers 33 rolling in a track 34 of the frame 4 and second rollers 35 running on either side of a track 36 of the frame 4. Pins 46 at the lower edge of each shutter 27, 28 steer in a groove 47 of the frame 4. The first and second shutters 27, 28 are driven by means of an electric motor 37 by means of a wire 38 driven by the electric motor 37. The wire 38 runs over a first wire roller 39 driven by the motor and a second opposed wire roller 40. The wire 38 is tensioned by means of a tensioning roller 41 held by a spring 42. The wire 38 is connected to each shutter 27, 28 by means of respective brackets 43.

The first and second pane parts 2, 3 are arranged manually displaceably in that rollers 44 at the top of each pane part 2, 3 roll in a track 45 of the frame 4. A lower edge 48 of the first and second pane parts 2, 3 steers in a groove 49 of the frame 4.

LIST OF REFERENCE NUMBERS t thickness of first layer of sound absorbing material
T thickness of second layer of sound absorbing material
1 acoustic shutter assembly
2 left window pane part
3 right window pane part
4 frame
5 inside of frame
6 outside of frame
7 ventilation duct
8 outer ventilation opening
9 inner ventilation opening
10 first layer of sound absorbing material
11 second layer of sound absorbing material
12 acoustic reflector
13 ventilation channel
14 first perforated plate
15 second perforated plate
16 first leg of V-formed acoustic reflector
17 second leg of V-formed acoustic reflector
18 top point of acoustic reflector
19 filter of outer ventilation opening
20 absorption module
21 first absorption cassette
22 second absorption cassette
23 top member of frame
24 bottom member of frame
25 first side member of frame
26 second side member of frame
27 first shutter
28 second shutter
29 sound absorbing foil
30 metal plate
31 U-formed profile
32 bracket
33 first roller
34 track of frame
35 second rollers
36 track of frame
37 electric motor
38 wire
39 first wire roller
40 second wire roller
41 tensioning roller
42 spring
43 brackets
44 roller of pane part
45 track of frame
46 pin of shutter
47 groove of frame
48 lower edge of pane part
49 groove of frame

The invention claimed is:

1. An acoustic shutter assembly adapted to cover a window opening in a wall, including at least one window pane arranged in a frame having an inside adapted to be mounted on the wall and an outside adapted to face away from the wall, wherein at least one ventilation duct is arranged in the frame between an outer ventilation opening and an inner ventilation opening, wherein the ventilation duct extends between a first layer of sound absorbing material arranged at the inside of the frame and a second layer of sound absorbing material arranged at the outside of the frame, and wherein the first and second layers of sound absorbing material extend at least substantially in parallel with the window pane, wherein a plurality of elongate acoustic reflectors are arranged between the first and second layers of sound absorbing material, wherein each of the acoustic reflectors extends across the frame from a location proximate the outer ventilation opening to a location proximate the inner ventilation opening so that the ventilation duct is separated into a number of respective ventilation channels formed between and defined at least in part by the acoustic reflectors, and further wherein each ventilation channel changes direction at least once between the outer ventilation opening and the inner ventilation opening, thereby at least substantially blocking any linear path from the outer ventilation-opening to the inner ventilation opening.

2. An acoustic shutter assembly according to claim 1, wherein the ventilation duct is lined by means of a first perforated plate covering the first layer of sound absorbing material and a second perforated plate covering the second layer of sound absorbing material so that the acoustic reflectors extend from the first perforated plate to the second perforated plate.

3. An acoustic shutter assembly according to claim 1, wherein the first layer of sound absorbing material has a first thickness (t) and the second layer of sound absorbing material has a second thickness (T), wherein the second thickness (T) is greater than the first thickness (t).

4. An acoustic shutter assembly according to claim 3, wherein the second thickness (T) is at least 4/3 the first thickness (t).

5. An acoustic shutter assembly according to claim 3, wherein the second thickness (T) is at least 3/2 the first thickness (t).

6. An acoustic shutter assembly according to claim 3, wherein the second thickness (T) is at least double the first thickness (t).

7. An acoustic shutter assembly according to claim 1, wherein each acoustic reflector is V-formed with a first leg extending obliquely towards the outer ventilation opening and a second leg extending obliquely towards the inner ventilation opening, and wherein the first and second leg of each acoustic reflector connect about midway between the outer ventilation opening and the inner ventilation opening in a top point of the acoustic reflector.

8. An acoustic shutter assembly according to claim 1, wherein each outer ventilation opening is covered by a filter in the form of a perforated plate.

9. An acoustic shutter assembly according to claim 1, wherein the at least one ventilation duct is formed in an absorption module including a first absorption cassette holding the first layer of sound absorbing material and a second absorption cassette holding the second layer of sound absorbing material, and wherein each absorption cassette has at least two opposed U-formed profiles holding opposed edges of the corresponding layer of sound absorbing material.

10. An acoustic shutter assembly according to claim 1, wherein the frame has four frame members in the form of a top member, a bottom member, a first side member and a second side member, wherein a first ventilation duct is arranged at the first side member and a second ventilation duct is arranged at the second side member.

11. An acoustic shutter assembly according to claim 10, wherein a first shutter is arranged in an open position at the first side member and a second shutter is arranged in an open position at the second side member, and wherein the first and second shutters are arranged displaceably to respective closed positions thereby covering the at least one window pane.

12. An acoustic shutter assembly according to claim 11, wherein a plurality of pane parts are arranged displaceably in a plane extending between a plane of the first and second layers of sound absorbing material and a plane in which the first and second shutters are arranged displaceably.

13. An acoustic shutter assembly according to claim 11, wherein the at least one window pane is separated in a first pane part arranged in an open position at the first side member and a second pane part arranged in an open position at the second side member, and wherein the first and second pane parts are arranged displaceably to respective closed positions in which the first and second pane parts meet each other and covers the window opening.

14. An acoustic shutter assembly according to claim 13, wherein the pane parts are arranged displaceably in a plane extending between a plane of the first and second layers of sound absorbing material and a plane in which the first and second shutters are arranged displaceably.

15. An acoustic shutter assembly according to claim 10, wherein the at least one window pane is separated in a first pane part arranged in an open position at the first side member and a second pane part arranged in an open position at the second side member, and wherein the first and second pane parts are arranged displaceably to respective closed positions in which the first and second pane parts meet each other and covers the window opening.

16. An acoustic shutter assembly according to claim 1, wherein at least one of the acoustic reflectors is curved from the outer ventilation opening to the inner ventilation opening to at least partially block the linear path from the outer ventilation-opening to the inner ventilation opening through at least one of the ventilation channels.

17. The acoustic shutter assembly according to claim 16, wherein the at least one acoustic reflector is curved into an arcuate shape.

18. An acoustic shutter assembly according to claim 1, wherein at least one of the acoustic reflectors is formed from a single piece of material extending across the frame.

19. An acoustic shutter assembly according to claim 1, wherein at least one of the acoustic reflectors is formed from a plurality of flattened planar segments.

20. An acoustic shutter assembly according to claim 1, wherein at least one of the acoustic reflectors extends fully across the frame from the outer ventilation opening to the inner ventilation opening.

* * * * *